United States Patent [19]

Aoki et al.

[11] Patent Number: 4,927,990

[45] Date of Patent: May 22, 1990

[54] SPRING-BIASED PUSH-BUTTON SWITCH HAVING A SPRING-LOADED TACTILE FEEDBACK FEATURE

[75] Inventors: Kazuo Aoki; Toshimi Chiba; Sadao Tachibana; Yasushi Nagatomo, all of Tokyo, Japan

[73] Assignee: Oki Electric Industry Co., Ltd., Tokyo, Japan

[21] Appl. No.: 319,140

[22] Filed: Mar. 3, 1989

[30] Foreign Application Priority Data

Mar. 31, 1988 [JP] Japan ..... 63-41829[U]

[51] Int. Cl.[5] ..... H01H 13/28

[52] U.S. Cl. ..... 200/517; 200/276.1; 200/430; 200/457; 200/521

[58] Field of Search ..... 200/517, 521, 341, 430, 200/431, 434, 457, 276.1, 276, 534, 342, 439, 530

[56] References Cited

U.S. PATENT DOCUMENTS

| | | | |
|---|---|---|---|
| 4,034,177 | 7/1977 | Sims, Jr. | 200/521 |
| 4,136,569 | 1/1979 | Hollweck | 200/521 X |
| 4,529,848 | 7/1985 | Cherry | 200/517 X |
| 4,540,865 | 9/1985 | Calder | 200/517 X |
| 4,751,355 | 6/1988 | Wisskirchen et al. | 200/521 |
| 4,755,645 | 7/1988 | Naoki et al. | 200/276.1 |

*Primary Examiner*—Renee S. Luebke

*Attorney, Agent, or Firm*—Flynn, Thiel, Boutell & Tanis

[57] ABSTRACT

A push-button switch comprises a fixed electrode; a movable electrode disposed opposite to the fixed electrode; a key housing having a tubular spring retainer, and an annular guide wall surrounding the tubular spring retainer and having a stopping flange, a coil spring received in the tubular spring retainer, and a key for operating the movable electrode through the coil spring. The coil spring has a large coil section, a middle extension coil section, and a small compression coil section having a projecting part. The tubular spring retainer is provided with a protrusion on the inner circumference thereof. When the key is depressed to close the switch, the projecting part of the coil spring is forced to move down over the protrusion in a snap motion, and the projecting part is forced to move up over the protrusion by the contractive force of the middle extension coil section and the recoiling force of the small compression coil section of the coil spring when the key is released. Thus, the operation of the switch can be detected by the sense of touch.

15 Claims, 8 Drawing Sheets

SPRING-BIASED PUSH-BUTTON SWITCH HAVING A SPRING-LOADED TACTILE FEEDBACK FEATURE

BACKGROUND OF THE INVENTION

1. Field of the Invention

The present invention relates to a push-buttom switch for use on the keyboard of an electronic equipment and, more particularly, to improvements in a push-button switch capable of making the operator detect the action of the contact thereof by the sense of touch.

2. Description of the Prior Art

Japanese Patent Laid-open Publication No. 60-81719 (U.S. Ser. No. 538,728: U.S. Pat. No. 4,528,431) discloses a push-button switch having a fixed contact point provided on a substrate, and a movable contact point operated by an operating key to open or close the switch, and capable of making the operator detect the action of the movable contact point by the sense of touch. The construction of this known push-button switch will be described hereinafter with reference to FIGS. 13, 14 and 15.

A frame 112 having a cylindrical supporting part 111 is attached to a substrate 114. A key 110 is mounted on the cylinderical supporting part 111 for sliding motion along the cylindrical supporting part 111. The key 110 has a stem 116 extended downward through the interior of the cylindrical supporting part 111. The free end of the stem 116 is bifurcated to form a skirt 117, and a projection 126 is formed on the outer surface of the extremity of the skirt 117. The projection 126 engages a shoulder 127 formed on the inner surface of the cylindrical supporting part 111 to limit the upward movement of the key 110.

A membrane switch 115 is provided on the substrate 114. An actuator 119 of a swing type is provided in place on the upper surface of the membrane switch 115. When the key 110 is depressed, the actuator 119 closes one of the contacts 120 of the membrane switch 115.

A compression coil spring 118 is provided between the key 110 and the actuator 119 with one end thereof seated on a spring seat 121 formed on the stem 116 of the key 110 and the other end thereof fitted on a stud 123 formed integrally with the actuator 119. The compression coil spring 118 is bent slightly in a predetermined direction. The lateral bend of the compression coil spring 118 is limited by the skirt 117 of the stem 116. The actuator 119 has a supporting portion 122 which serves as a pivot in the initial stage of turning motion of the actuator 119, and a projecting portion 124 having a downward convex curved bottom surface. As shown in FIG. 13, a small gap is formed between the projecting portion 124 and the upper surface of the membrane switch 115 at a position corresponding to the contact 120 when the key 110 is not depressed. When the key 110 is depressed to a position shown in FIG. 14, a force acting through the compression coil spring 118 on the actuator 119 increases.

FIG. 15 shows the relation between the pressure applied to the key 110 and the displacement of the key 110. When the key 110 is depressed, a force greater than a force acting on the actuator 119 while the actuator 119 is at an idle position acts on the actuator 119, and a clockwise moment resulting from the bending of the compression coil spring 118 exceeds a counterclockwise moment acting on the actuator 119 while the actuator 119 is at the idle position. Consequently, the actuator 119 turns clockwise on the extremity of the supporting portion 122 thereof, so that the projecting portion 124 of the actuator 119 presses the upper surface of the membrane switch 115 at the position corresponding to the contact 120 to close the contact 120 as shown in FIG. 14. In FIG. 15, a point 131 indicates the status of the key 110 when the contact 120 is closed. When the contact 120 is thus closed, the compression coil spring 118 is bent greatly as shown in FIG. 14, which is detected by the opertor by the sense of touch. Upon the detection of such a mode of bending of the compression coil spring 118, the operator releases the key 110. In an initial period after the key 110 has been released, the actuator 119 continues to turn clockwise because the decreasing rate of the pressure acting on the actuator 119 is greater than the decreasing rate of the clockwise moment acting on the actuator 119 and hence the contact 120 remains closed. Since the compression coil spring 118 tends to recoil, the clockwise moment decreases. A point 132 in FIG. 15 indicates the status of the key 110 under such a condition. Shortly, the counterclockwise moment acting on the actuator 119 exceeds the clockwise moment acting on the actuator 119, and then the actuator 119 starts turning counterclockwise to the idle position. A point 133 in FIG. 15 indicates the status of the key 110 under a condition where the key 110 has returned to its initial position and the actuator 119 is at the position shown in FIG. 13. The deviation of the position of the key 110 in the state indicated by the point 133 from the position of the same in a status indicated by a point 130 is zero. However, the force acting on the key 110 in the status indicated by the point 133 is different slightly from that acting on the same in the status indicated by the point 130 due to frictional resistance against the movement of the key 110.

As is obvious from FIG. 15, the physical hysteresis in the motion of the key 110 indicates that the switching operation of the contact 120 gives a responsive effect, which enables the operator to detect the switching operation of the contact 120. That is, the switching operation of the contact 120 causes a slight movement of the key 110, which can be detected by the operator by the sense of touch.

However, the foregoing known push-button switch has drawbacks that actuators of a complicated shape and many parts are necessary to enable the operator to detect the switching operation of the contacts by the sense of touch, the keys and the actuators must be inserted respectively in different directions increasing the steps of assembling work in assembling the push-button switch, and hence the push-button switch is expensive. Furthermore, the substrate must be removed even in replacing a single faulty actuator with a new one for repair, which requires much time and labor.

SUMMARY OF THE INVENTION

Accordingly, it is an object of the present invention to provide a push-button switch eliminating the foregoing drawbacks of the conventional push-button switch, comprising a reduced number of parts, facilitating the assembling work, capable of being manufactured at a reduced cost, and facilitating work for repairing the push-button switch in case of malfunction.

To achieve the object of the invention, the present invention provides a push-button switch comprising: a substrate; a fixed electrode provided on the substrate; a movable electrode corresponding to the fixed electrode; a key housing having an upright tubular spring retainer formed in the central portion of the bottom wall thereof; a key for operating the movable electrode, slidably fitted on the tubular spring retainer for sliding movement within a range limited by stopper means; and a coil spring both for returning the key and for depressing the movable electrode, integrally having a large coil section seated on the tubular spring retainer of the key housing, a middle extension coil section receiving a stem formed integrally with the key therein, and a small compression coil section connected to the middle extension coil section; characterized in that a portion of one of the small compression coils of the small compression coil section of the coil spring is projected radially outward to form a projecting part, and a protrusion is formed on the inner circumference of the tubular spring retainer of the key housing in a shape so that the projecting part of the small compression coil section can be moved over the protrusion by a force that acts on the projecting part of the small compression coil section in depressing the key and by a force that acts on the projecting part of the small compression coil section when the key is released.

In assembling the push-button switch of the present invention, first, the coil spring is put in the tubular spring retainer with the small compression coil section foremost so that the upper large coil section thereof is seated on a shoulder formed in the upper end of the tubular spring retainer. Then, the key is put on the tubular spring retainer with the stem thereof received in the middle extension coil section of the coil spring. Thus, the key housing, the coil spring and the key can be assembled easily by inserting the coil spring and the key in the key housing in the same direction. In this state, the stem of the key is fitted in the middle extension coil section of the coil spring, the lower end of the stem rests on a shoulder between the middle extension coil section and the small comprssion coil section, and the projecting part of the small compression coil section engages the upper surface of the protrusion formed on the inner circumference of the tubular spring retainer. The large coil section of the coil spring is seated in place on the shoulder formed in the upper end of the tubular spring retainer. Although the middle extension coil section is strained slightly to apply an upward force to the key, the upward movement of the key is limited by the stopper means, so that the key is positioned at a predetermined uppermost position.

The middle extension coil section of the coil spring is an extension coil spring for urging the key upward to the uppermost position. The small compression coil section of the coil spring is a compression coil spring for depressing the movable electrode. The movement of the projecting part of the small compression coil section over the protrusion formed on the inner circumference of the tubular spring retainer can be detected by the operator by the sense of touch. That is, the key moves downwrd along the tubular spring retainer when depressed, consequently, the middle extension coil section of the coil spring is extended by the stem of the key, and the small compression coil section is compressed. When the compressive force acting on the small compression coil section exceeds a resistance of the protrusion against the projecting part of the small compression coil section, the projecting part of the coil moves downward over the protrusion and the small compression coil section snap extends to depress the movable electrode, so that the switch is closed. The snap movement of the projecting part of the small compression coil section over the protrusion enables the sensual detection of closing of the contact. When the key is released, the key is urged upward by the contractive force of the middle extension coil section and the recoiling force of the small compresson coil section. Since the contractive force of the middle extension coil section is greater than the resistance of the protrusion against the projecting part of the small compression coil section, the projecting part moves upward over the protrusion, so that the key is returned to the uppermost position.

The above and other objects, features and advantages of the present invention will become more apparent from the following description taken in conjunction with the accompanying drawings.

DESCRIPTION OF THE PREFERRED EMBODIMENT

Figure 1:
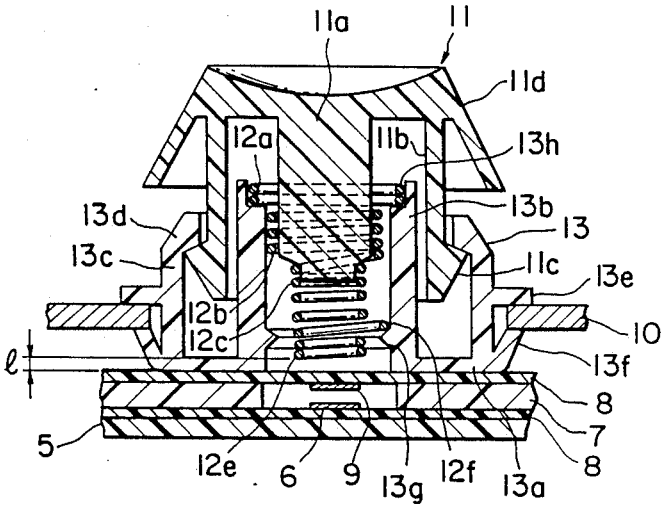
FIG. 1 is a longitudinal sectional view of a push-button switch in a first embodiment according to the present invention, in which the contact is open.
Figure 2:
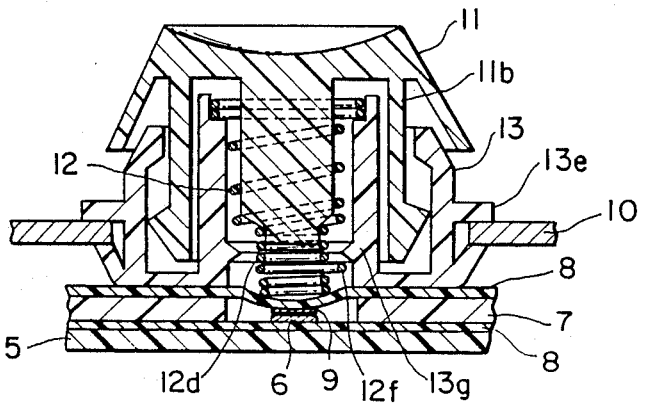
FIG. 2 is a longitudinal sectional view of the push-button switch of FIG. 1, in which the contact is closed.

Referring to FIGS. 1 and 2, there are shown a substrate 5, a fixed contact point 6 provided on the substrate 5, a spacer 7, a flexible member 8 provided over the spacer 7, a movable electrode 9 attached to the lower surface of the flexible member opposite to the fixed electrode 6, a switch holding frame 10, a key 11 having a key head 11*d*, a stem 11*a* projecting from the central portion of the lower surface of the key head 11*d*, and legs 11*b* extending downward from the key head 11*d* around the stem 11*a* and each having a tapered claw 11*c* at the lower end thereof, a coil spring 12, and a key housing 13.

Figure 3:
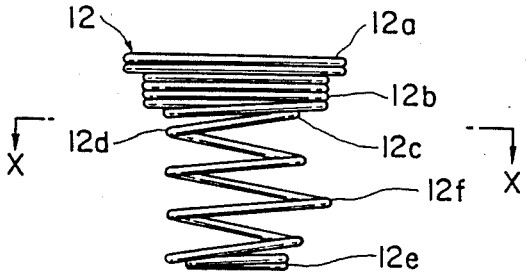
FIG. 3 is a front elevation of a coil spring employed in the push-button switch of FIG. 1.

Referring to FIG. 3, the coil spring 12 has an upper large coil section 12*a*, a middle extension coil section 12*b*, an upper parallel section 12*c*, a small compression coil section 12*d* and a lower parallel section 12*e*, which are formed integrally in that order. The sections 12*c*, 12*d* and 12*e* together form an end coil portion of the spring 12. A portion of one of the coils of the small compression coil section 12*d* is deformed radially outward to form a projecting part 12*f*.

The key housing 13 has a bottom wall or base 13*a*, a tubular spring retainer 13*b* extending upright from the central portion of the bottom wall 13*a* and provided with a shoulder 13*h* in the upper end theeof, a substantially annular guide wall 13*c* surrounding the tubular spring retainer 13*b*, a stopping flange 13*d* inwardly extending from the upper end of the guide wall 13*c*, a flange 13*e* extending radially outward from the outer circumference of the guide wall 13*c*, and locking claws 13*f* projecting from the outer circumference of the bottom wall 13*a*. The key housing 13 is retained firmly on the frame 10 by means of the flange 13*e* and the locking claws 13*f* clamping the frame 10 therebetween.

In assembling the push-button switch, first, the coil spring 12 is put in the tubular spring retainer 13*b* of the key housing with the lower parallel section 12*e* foremost to position the coil spring 12 in the tubular spring retainer with the large coil section 12*a* seated on the shoulder 13*h* formed in the upper end of the tubular spring retainer 13*b*. In this state, a small predetermined gap of l is formed between the lower parallel section 12*e* and the flexible member 8. Then, the key 11 is put on the annular guide wall 13*c* of the key housing 13 with the tapered claws 11*c* of the legs 11*b* thereof on the stopping flange 13*d*, and then the key 11 is depressed so that the legs 11*b* are bent elastically to allow the tapered claws 11*c* of the legs 11*b* to slip into the interior of the annular guide wall 13*c* of the key housing 13 over the stopping flange 13*d*. In this state, the stem 11*a* of the key 11 is inserted in the middle extension coil section 12*b* of the coil spring 12 with the lower end thereof in abutment with the upper parallel section 12*c* formed between the middle extension coil section 12*b* and the small compression coil section 12*d*, and the tapered claws 11*c* of the key 11 engage the stopping flange 13*d* of the key housing 13. Since the large coil section 12*a* of the coil spring 12 is seated on the shoulder 13*h*, the middle extension coil section 12*b* is extended slightly, and hence the key 11 is urged upward through the stem 11*a* by the coil spring 12, whereby the tapered claws 11*c* are pressed against the inner surface of the stopping flange 13*d* to position the key 11. The projecting part 12*f* of the small compression coil section 12*d* of the coil spring 12 is in engagement with the protrusion 13*g* formed in the inner circumference of the tubular spring retainer 13*b*, so that the predetermined gap of l is formed between the lower parallel section 12*e* and the flexible member 8.

In operation, when the key 11 of the push-button switch in the status shown in FIG. 1, in which the switch is open, is depressed, the key 11 moves downward along the tubular spring retainer 13*b* of the key housing 13 by being guided by the annular guide wall 13*c* of the key housing 13 pushing the upper parallel section 12*c* of the coil spring 12 with the stem 11*a* to extend the middle extension coil section 12*b* of the coil spring 12.

Figure 4:
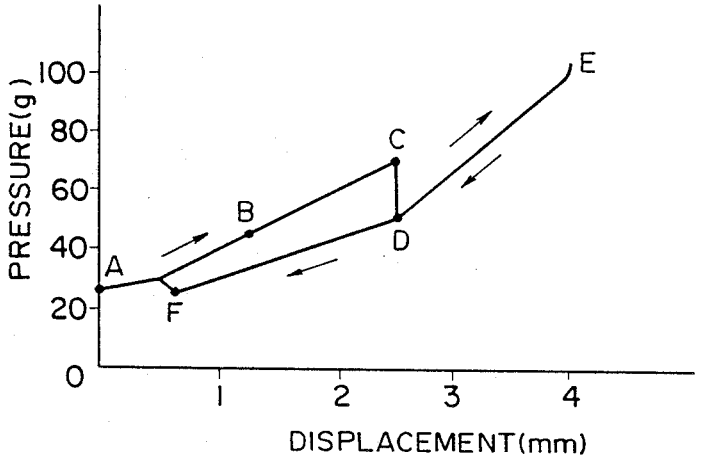
FIG. 4 is a graph showing the relation between the displacement of a key and the pressure acting on the key.
Figure 5A:
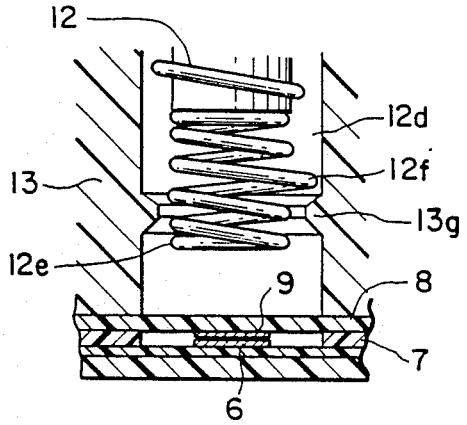
FIGS. 5(*a*) to 5(*e*) are fragmentary sectional views of the push-button switch of FIG. 1, showing the statuses of the coil spring in the push-button switch of FIG. 1, corresponding respectively to points A to F in the graph of FIG. 4.
Figure 5B:
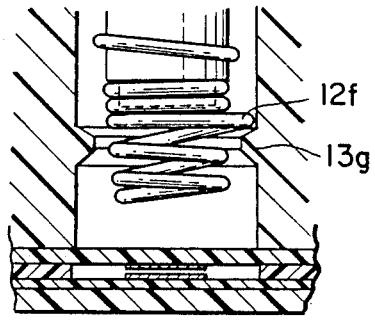
Figure 5C:
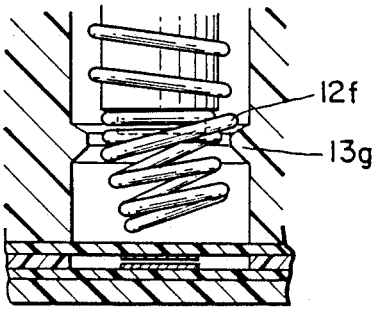
Figure 5D:
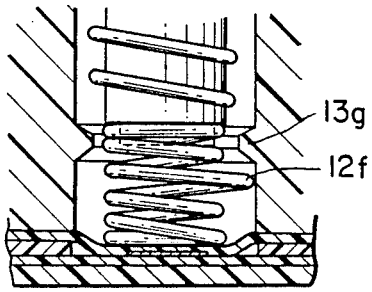
Figure 5E:
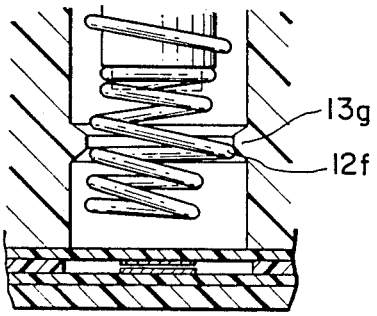

In FIG. 4 showing the relation between the pressure applied to the key 11 and the displacement of the key 11, a point A indicates a status in which the key 11 of the push-button switch is not depressed, a point B indicates a status in which the key 11 is depressed to an extent where the projecting part 12*f* of the coil spring 12 has not yet moved down over the protrusion 13*g* and hence the small compression coil section 12*d* of the coil spring 12 is compressed, a point C indicates a status in which the key 11 is depressed to an extent where resistance against the downward movement of the key 11 is increasing progressively, the projecting part 12*f* of the coil spring 12 is deformed elastically and is almost moving down over the protrusion 13*g*, a point D indicates a status in which the projecting part 12*f* of the coil spring 12 has just moved down over the protrusion 13*g* and hence the small compression coil section 12*d* of the coil spring 12 has extended, so that the flexible member 8 is depessed to bring the movable contact point 9 into contact with the fixed electrode 6 provided on the substrate 5, whereby the switch is closed, and a point E indicates a status in which the lower ends of the legs 11*b* of the key 11 are in contact with the upper surface of the bottom wall 13*a* of the key housing 13.

When the status of the push-button switch changes from that indicated by the point C to that indicated by the point D, namely, when the projecting part 12*f* of the coil spring 12 moves down over the protrusion 13*g*, the pressure necessary for depressing the key 11 decreases from a pressure at the point C to a pressure at the point D, so that the operator is able to detect the closing of the switch by the sense of touch. When the key 11 is released, the middle extension coil section 12*b* of the coil spring 12 is allowed to contract and the small compression coil section 12*d* of the coil spring 12 is allowed to extend, so that the key 11 is pushed upward by the contractive force of the middle extension coil section 12*b* and the recoiling force of the small compression coil section 12*d*, and the pressure acting on the flexible member 8 decreases. Consequently, the movable electrode 9 is separated from the fixed electrode 6 to open the switch.

As the key 11 is moved further upward, the projecting part 12*f* of the coil spring 12 engages the lower surface of the protrusion 13*g*. Since the contractive force of the middle extension coil section 12*b* is greater than a force necessary to move the projecting part 12*b* up over the protrusion 13*g*, the projecting part 12*b* moves up over the protrusion 13*g*. Consequently, the status changes from that indicated by the point E through those indicated by the points D and F to that indicated by the point A, namely, the initial status.

The contact of the push-button switch is thus operated and the operator is able to detect the closing and opening of the switch by the sense of touch through the sensuous detection of the variation of the resistance against the depression of the key 11 which occurs when the projecting part 12*f* moves over the protrusion 13*g*.

Figure 6:
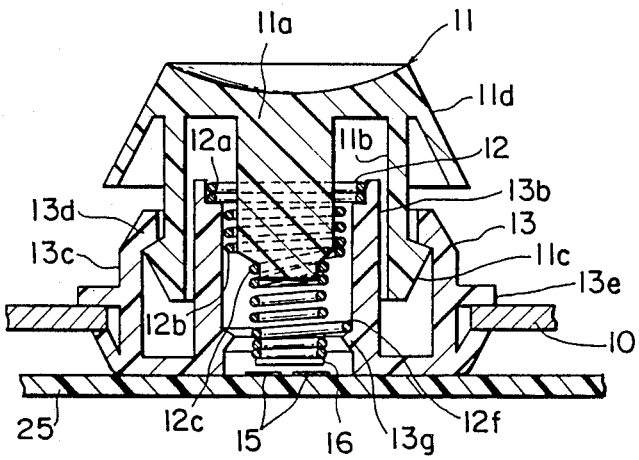
FIG. 6 is a longitudinal sectional view of a push-button switch in a second embodiment according to the present invention.

Although the push-button switch described hereinbefore is of a so-called membrane type having a flexible membrane (the flexible member 8) and a movable electrode (the movable electrode 9), the present invention is applicable also to a push-button switch of a capacitance type as shown in FIG. 6 having fixed electrode 15 provided on a substrate 25, and a movable electrode 16 attached to the lower parallel section 12*e* of a coil spring 12 similar to that of the first embodiment.

Figure 7:
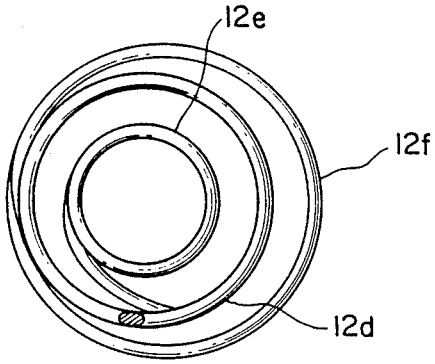
FIGS. 7, 8 and 9 are plan views, taken along the line X-X of FIG. 3, of modifications of the coil spring, respectively having modified projecting parts.
Figure 8:
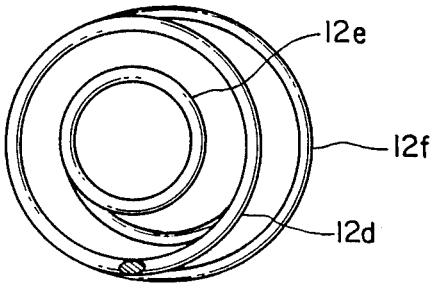
Figure 9:
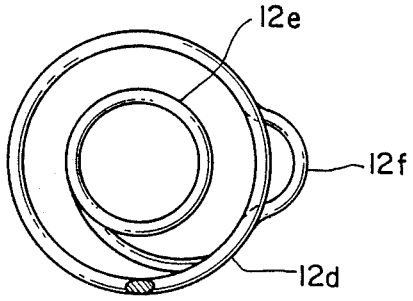

The lower portion of the coil spring in FIG. 3, namely the projection part 12*f* of the coil spring 12 may be modified as illustrated in FIGS. 7 to 9. FIGS. 7 to 9 are plan views taken along X-X of FIG. 3 of the modified coil springs (upper portions thereof are same as that shown in FIG. 3 so that the lower portions thereof are taken along X-X of FIG. 3). The projecting part 12*f* of the small compression coil section 12*d* of the coil spring 12 may be an eccentric circular coil having a diameter greater than that of the rest of the coils of the small compression coil section 12*d* (FIG. 7), an elliptic coil (FIG. 8), a coil having a partial projecting part or a coil having any other suitable shape (FIG. 9).

Figure 10:
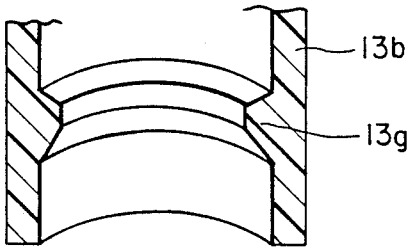
FIGS. 10 and 11 are fragmentary sectional perspective views of modifications of the tubular spring retainer, respectively having modified protrusions.
Figure 11:
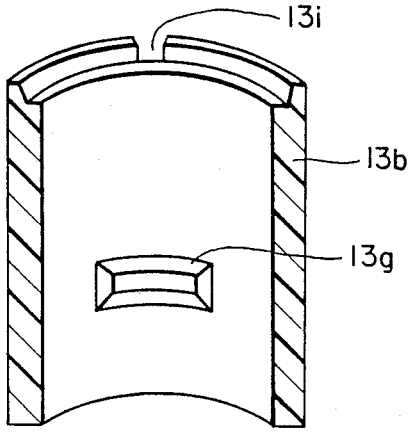
Figure 12:
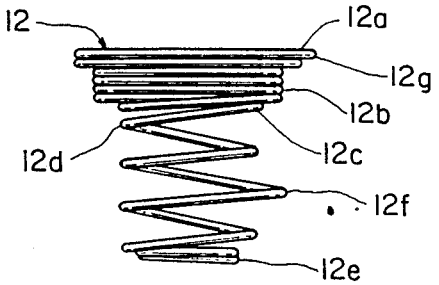
FIG. 12 is a front elevation of a coil spring suitable for use in combination with the tubular spring retainer of FIG. 11.
Figure 13:
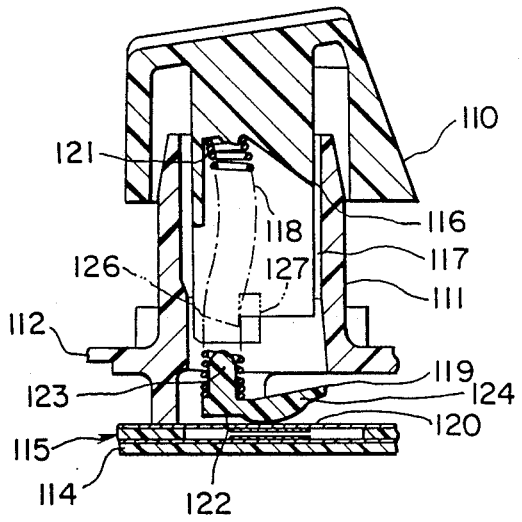
FIG. 13 (PRIOR ART)
FIG. 13 is a longitudinal sectional view of a conventional push-button switch, in which the contact is open.
Figure 14:
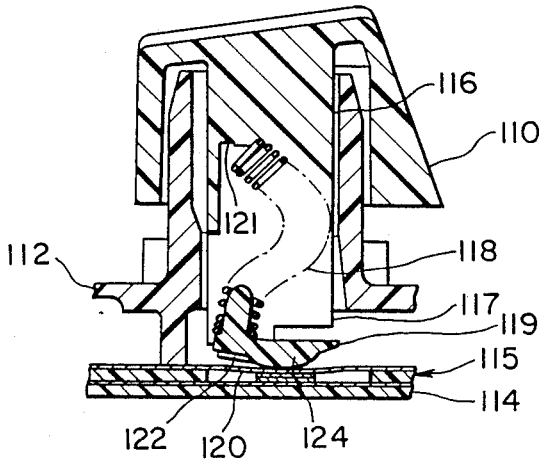
FIG. 14 (PRIOR ART)
FIG. 14 is a longitudinal sectional view of a conventional push-button switch of FIG. 13, in which the contact is closed.
Figure 15:
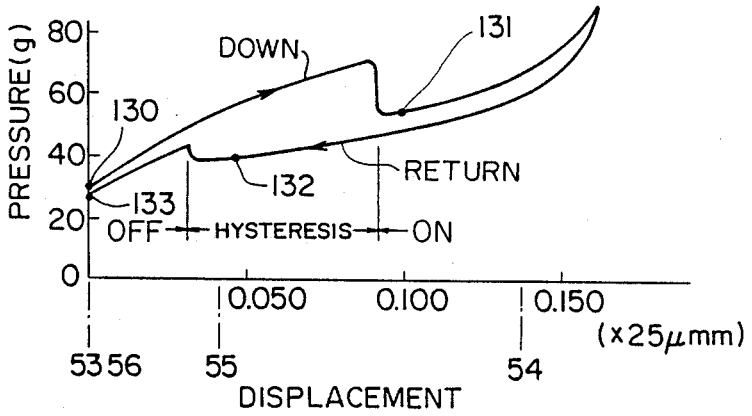
FIG. 15 (PRIOR ART)
FIG. 15 is a graph showing the relation between the displacement of the key of the push-button switch of FIG. 13 and the pressure acting on the key.

Furthermore, the protrusion 13*g* formed on the inner circumference of the tubular spring retainer 13*b* of the key housing may be an annular protrusion (FIG. 10) or a local protrusion (FIG. 11). When the protrusion 13*g* is a local protrusion, a positioning slot 13*i* is formed in the upper end of the tubular spring retainer 13*b* and the coil spring 12 is put in the tubular spring retainer 13*b* with a stopping projection 12*g* formed at the free end of the coils of the large coil section 12*a* thereof engaging the slot 13*i* to fix the circumferential position of the coil spring 12 relative to the tubular spring retainer 13*b* so that the projection 12*f* of the coil spring 12 coincides with the protrusion 13*g*.

As is apparent from the foregoing description, according to the present invention, a mechanism for giving a sensuous stimulus indicating the operation of a push-button switch can be constructed by a single coil spring and a protrusion formed on the inner circumference of a tubular spring retainer for retaining the coil spring without requiring any additional parts including an actuator having a complicated shape which is essential to the conventional push-button switch. Accordingly, the push-button switch of the present invention comprises a reduced number of parts, has a simple construction, enables the insertion of the coil spring and the key in the same direction in assembling the push-button switch, thus facilitating the assembling process, and reduces the manufacturing cost of the push-button switch remarkably.

Furthermore, since the coil spring is a single member integrally having a plurality of functional sections, and the key and the coil spring are inserted in the key housing in the same direction, the key and the coil spring can be changed very simply for repair, which facilitates the maintenance of the push-button switch effectively.

Although the invention has been described in its preferred forms with a certain degree of particularity, obviously many changes and variations are possible therein. It is therefore to be understood that the invention may be practiced otherwise than specifically described herein without departing from the scope and spirit thereof.

What is claimed is:

1. In a push-button switch including:

a substrate;

a fixed electrode provided on the substrate;

a movable electrode disposed opposite to the fixed electrode;

a key housing having a base and a tubular spring retainer projecting from a central portion of the base, said tubular spring retainer having an inner shoulder formed in an end thereof opposite said base, and an annular guide wall surrounding the tubular spring retainer and having a stopping flange extending substantially radially inwardly from an end thereof opposite said base;

a coil spring received in the tubular spring retainer of the key housing with a portion thereof opposite said base seated on a surface defined by the shoulder and facing away from said base; and a key for operating the movable electrode, having a key head, a central stem extending from a central portion of a lower surface of the key head so as to be inserted in the coil spring, and legs formed around the stem so as to extend from the lower surface of the key head, each said leg being provided at a free end thereof with a tapered claw, said key being axially slidably fitted in the key housing with the stem axially received in the coil spring in the tubular spring retainer and with the tapered claws of the legs disposed radially between said tubular spring retainer and said annular guide wall, and engaging the stopping flange of the annular guide wall;

the improvement wherein the coil spring comprises a large coil section seated on said shoulder, a middle extension coil section, and a small compression coil section, which are formed integrally in that order from said shoulder to said base, a radially inwardly directed protrusion is formed on a radially inner surface of the tubular spring retainer, and said small compression coil section includes a radially outwardly projecting part which engages a surface of the protrusion facing away from said base while the key is not depressed, the projecting part of the coil spring snapping across the protrusion toward said base when the key is depressed extending the middle extension coil section and compressing the small compression coil section, and the projecting part being caused to snap back across the protrusion by the contractive force of the middle extension coil section and the recoiling force of the small compression coil section when the key is released.

2. A push-button switch according to claim 1, wherein said movable electrode is disposed opposite to said fixed electrode on a flexible member placed adjacent said substrate, said substrate and said flexible member having a spacer therebetween.

3. A push-button switch according to claim 1, wherein said projecting part is a portion of an eccentric circular coil having a diameter greater than that of the rest of the coils of said small compression coil section.

4. A push-button switch according to claim 1, wherein said projecting part is a portion of an elliptic coil among the coils of said small compression coil section.

5. A push-button switch according to claim 1, wherein said projecting part is an outwardly deformed projecting portion of one of the coils of said small compression coil section.

6. A push-button switch according to claim 1, wherein said protrusion is an annular protrusion.

7. A push-button switch according to claim 1, wherein said protrusion is a local protrusion extending circumferentially for only a limited distance, a stopping projection is formed at a free end of the large coil section of said coil spring, and a positioning slot is formed in the end of the tubular spring retainer opposite said base to receive the stopping projection therein to position said coil spring relative to said tubular spring retainer so that the projecting part of said coil spring is substantially radially aligned with the local protrusion.

8. A push-button switch according to claim 1, wherein said fixed electrode includes two separate electrodes, and said movable electrode is attached to an end of said coil spring adjacent said base.

9. A push-button switch having tactile feedback, comprising:

a substrate with a fixed electrode provided thereon;

a key housing including a tubular spring retainer supported stationarily relative to said fixed electrode;

a coil spring received in said tubular retainer and having a tension coil portion and an end coil portion which are substantially coaxial, said tension coil portion being secured at a first end thereof to said tubular retainer;

a key having a head and a stem extending away from said head, said stem being axially received in said tension coil portion from said first end and being secured to a second end of said tension coil portion, said stem being axially reciprocally movable in said tubular retainer, said tension coil portion of said coil spring yieldably biasing said stem in a first direction toward said first end of said tension coil portion and yieldably retaining said stem in a biased position, said end coil portion being secured at a first end thereof to said stem adjacent said second end of said tension coil portion, said end coil portion extending from said stem in a second direction substantially opposite said first direction and terminating in a free end which is axially spaced from said stem, said free end of said end coil portion being freely axially floating, and said end coil portion being carried on said stem for reciprocal axial movement relative to said tubular retainer;

a movable electrode disposed axially between said free end of said end coil portion and said fixed electrode;

said key being movable in said second direction against the biasing of said tension coil portion to a switch activation position where said free end of said end coil portion, as carried on said stem, presses said movable electrode axially into contact with said fixed electrode; and said tubular retainer having a radially inwardly directed protrusion formed on an interior surface thereof, said end coil portion having a radially outwardly projecting part which radially overlaps said protrusion of said tubular retainer, said projecting part being axially located on said end coil portion such that movement of said stem between said biased position and said switch activation position causes said projecting part to axially engage and snap across said protrusion to provide a clear tactile feedback to the operator of the switch.

10. The apparatus according to claim 9, wherein said protrusion extends circumferentially for only a limited distance, said tension coil portion including a stopping projection at said first end thereof, said tubular retainer having a positioning slot formed therein adjacent said first end of said tension coil portion and circumferentially offset from said protrusion by a first amount, said stopping projection being radially received in said positioning slot, said stopping projection and said projecting part of said end coil portion being circumferentially offset from each other by a second amount substantially equal to said first amount by which said positioning slot and said protrusion are circumferentially offset from each other such that, when said stopping projection is received in said positioning slot, said porjecting part is substantially radially aligned with said protrusion.

11. The apparatus according to claim 10, wherein said projecting part is a portion of an eccentric circular coil of said end coil portion, said eccentric circular coil having a diameter greater than that of the remaining coils of said end coil portion.

12. The apparatus according to claim 10, wherein said projecting part is a portion of an elliptic coil of said end coil portion.

13. The apparatus according to claim 10, wherein said projecting part is an outwardly deformed projecting portion of a coil of said end coil portion.

14. A push-button switch having tactile feedback, comprising:

a first substrate having a fixed electrode provided thereon;

a second substrate having a flexible part provided with a movable electrode thereon and maintained normally spaced from the fixed electrode;

a sleevelike housing projecting outwardly from the second substrate and having a bore extending therethrough in alignment with the flexible part of the second substrate;

a key having an accessible head part adjacent an outer end of the housing and a stem part which projects into the bore and is movable relative to the housing, the stem part having a free end which is maintained in spaced relationship from the flexible part of the second substrate;

spring means coupled between said housing and said key for supportingly permitting movement of the key between an outer open position and an inner closed position wherein the switch, as defined by the fixed and movable electrodes, is closed, said spring means normally biasing said key into said outer position;

said spring means including a multiple coil one-piece spring having a supporting coil section which is stationarily and supportingly engaged with said stem part adjacent the free end thereof, said spring also having a multiple-coil compression coil section which is joined to the supporting coil section and projects in a cantilevered manner away from the free end of the stem part in a direction toward the flexible part of said second substrate, said compression coil section terminating in a free end which is normally maintained in spaced relationship from the flexible part of the second substrate when the key is in said open position, the free end of said compression coil section being adapted to engage and deflect the flexible part when the key is moved into the closed position; and tactile sensing means coacting between said housing and said spring means for sensing activation of said key, said tactile sensing means including a projection which is fixed to said housing and projects radially inwardly into said bore through a selected radial extent, and an intermediate coil of said compression coil section being deformed radially outwardly relative to adjacent coils so as to effect contact with and snap over said projection when said key is moved between said open and closed positions and causes corresponding movement of said compression coil section, said intermediate coil being located in spaced relationship between the free end of said stem part and the free end of said compression coil section.

15. A push-button switch according to claim 14, wherein said spring means includes a tension coil section which is integrally joined to said supporting coil section and projects away therefrom in a direction opposite from that of said compression coil section, said tension coil section being disposed in surrounding relationship to said stem part and terminating in an end portion which is seated on said housing.

* * * * *

UNITED STATES PATENT AND TRADEMARK OFFICE

CERTIFICATE OF CORRECTION

PATENT NO. : 4 927 990

DATED : May 22, 1990

INVENTOR(S) : Kazuo AOKI et al

It is certified that error appears in the above-identified patent and that said Letters Patent is hereby corrected as shown below:

Column 9, line 64; change "porjecting" to ---projecting---.

Signed and Sealed this

Twenty-fourth Day of December, 1991

*Attest:*

HARRY F. MANBECK, JR.

*Attesting Officer*

*Commissioner of Patents and Trademarks*